US005992662A

United States Patent [19]

Holt et al.

[11] Patent Number: 5,992,662

[45] Date of Patent: Nov. 30, 1999

[54] CONTAINER STAND ADAPTER

[75] Inventors: Roberta J. Holt; Raymond A. Roenker, Jr., both of Virginia Beach, Va.; Walter J. Monahan; Anthony L. Gelardi, both of Kennebunkport, Me.

[73] Assignee: Dakota Enterprises, LLC, Virginia Beach, Va.

[21] Appl. No.: 08/685,863

[22] Filed: Jul. 24, 1996

[51] Int. Cl.[6] ..... B65D 25/24; B65D 25/38

[52] U.S. Cl. ..... 215/395; 141/319; 215/228; 220/630; 222/185.1

[58] Field of Search ..... 215/228, 227, 215/307, 317, 353, 392, 393, 395, 386; 220/630, 729, 731, 744, 212, 23.86; 141/319; 222/185.1

[56] References Cited

U.S. PATENT DOCUMENTS

| | | | |
|---|---|---|---|
| 134,302 | 12/1872 | Miller | 215/392 |
| 811,742 | 2/1906 | Petrie | 215/392 |
| 1,865,023 | 6/1932 | Leavy . | |
| 2,024,910 | 12/1935 | Cramer | 220/212 |
| 2,069,048 | 1/1937 | Rehberger | 220/212 X |
| 2,076,826 | 4/1937 | Reinsberg | 220/212 X |
| 2,280,940 | 4/1942 | Wightman . | |
| 2,321,519 | 6/1943 | Rubinoff | 215/392 X |
| 2,443,086 | 6/1948 | Turenne | 215/353 X |
| 2,562,496 | 7/1951 | Kirsch . | |
| 2,767,744 | 10/1956 | Beerman | 141/319 |
| 2,778,521 | 1/1957 | Cagle | 215/228 |
| 2,827,194 | 3/1958 | Matton | 215/228 X |
| 2,933,751 | 4/1960 | Brownstein | 215/392 X |
| 2,990,080 | 6/1961 | Harris . | |
| 3,156,272 | 11/1964 | Indrunas | 141/319 |
| 3,317,069 | 5/1967 | Chin . | |
| 3,402,844 | 9/1968 | Chin . | |
| 4,101,044 | 7/1978 | Paquette et al. . | |
| 5,263,787 | 11/1993 | Wilcox et al. | 215/353 X |
| 5,402,899 | 4/1995 | Ammeson . | |
| 5,470,537 | 11/1995 | Siegel . | |

*Primary Examiner*—Stephen P. Garbe
*Assistant Examiner*—Niki M. Eloshway
*Attorney, Agent, or Firm*—James Creighton Wray; Meera P. Narasimhan

[57] ABSTRACT

A stand adapter holds containers, such as bottles, in inverted positions for facilitating pouring of viscous contents. The stand adapter is a one-piece structure that includes a mounting plate having a central opening, side walls extending from the inner surface of the mounting plate and an open base defined by distal free edges of the side walls. The opening in the mounting plate has dimensions for receiving a bottle neck and for frictionally engaging surface features of the outer walls of the neck portion of the bottle. The side walls of the adapter have sufficient width and thickness so that the bottle is sturdily supported in an inverted position. Opposing side walls are spaced such that a person's fingers and thumb easily extend between the side walls for twisting, pulling or flipping open the bottle cap. The side walls may form a continuous ring or may have cutout regions for allowing lateral access to the bottle cap and for facilitating non-vertical pouring of the contents of the bottle. The adapter may have any shape, size and width and may be integral with or separable from the bottle. The connection of the adapter may be inward of the cap or may connect directly to the cap so that the cap/adapter combination may be unscrewed as a unit. To connect the stand adapter to a bottle, the bottle cap is removed and the neck of the bottle is urged through the opening in the mounting plate of the adapter. The edges defining the opening engage the walls of the neck, securely connecting the stand adapter to the neck.

28 Claims, 4 Drawing Sheets

CONTAINER STAND ADAPTER

BACKGROUND OF THE INVENTION

The present invention relates to bottle adapters for facilitating pouring of viscous substances from bottles.

Generally, viscous condiments, such as catsup and mustard, are packaged in plastic or glass bottles. Pour spouts or caps are screwed on threaded open end necks of the bottles. The bottles are sold and stored in upright positions. Most food bottles have a security seal across the open end. A screw cap covers the security seal. A compressible insert in the cap seals the bottle after the security seal has been punctured or removed. Pour spouts have secondary openings with secondary seals which flip or axially slide open or closed. To dispense condiments from the bottles, the spouts or caps are opened or removed, the bottles are tipped and the contents of the bottles are urged toward and out of the open end by gravity or under pressure caused by squeezing plastic bottles. Efforts to dispense the viscous condiments may be frustrating and time consuming and often result in overpouring. Needs exist for inexpensive improvements that provide immediate and controlled dispensing of the bottle contents.

SUMMARY OF THE INVENTION

The present invention is a stand adapter for providing immediate and controlled pouring of liquid contents. The invention holds a container, such as a glass or plastic bottle, in an inverted position. The stand adapter provides easy access for removal or opening of the cap or lid. Pouring is facilitated without interference from the stand.

The stand adapter is a one-piece molded structure having a base, side walls extending upward from the base and a mounting plate at upper edges of the side walls. The mounting plate includes an opening having dimensions for engaging the neck of the container. The side walls, which extend from the base, have sufficient width and thickness to support a full bottle in an inverted position. Opposing side walls are spaced such that a person's fingers easily extend between the side walls for opening and closing by twisting or flipping, pulling or pushing bottle caps. Preferably, the side walls do not extend from all edges of the mounting plate. Rather, at least one cutout region is provided in the side walls for lateral access to the bottle cap or pour spout. The cutout region in the side walls permits pouring of the contents through the cutout region while the bottle is tipped. Without the cutout region, the bottle would have to be held vertically or the poured fluid would contact and befoul the stand.

The present adapter may have any shape, size and width and may be integral with or separable from the container. The mounting plate may be planar, curved or semispheroidal. Separable embodiments of the present adapter are securely mounted to the neck of the bottle by inserting the neck through the opening in the mounting plate of the adapter. In another preferred embodiment, the stand adapter is molded to the walls of a pouring spout-type cap which in turn is connectable to the threaded end of a bottle. The connection of the stand adapter may be inward of the bottle cap for capturing by the bottle cap. Alternatively the stand adapter may be fixed by bonding, welding or molding on the bottle cap so that the cap and stand adapter may be mounted and removed as a unit.

In preferred embodiments, the adapter connects to another region of the bottle, such as the bottom of the bottle, when the adapter is removed from the bottle neck. Preferably, for retail and packaging, the cap is removed, the adapter is inverted and the cap is replaced, holding the adapter side walls along the walls of the container.

In preferred embodiments the opening in the mounting plate of the stand adapter has dimensions for receiving a neck of a standard bottle, such as a sauce, salad dressing, salsa, catsup, mustard or shampoo bottle. The opening in the mounting plate may be adjustable, thereby allowing the adapter to fit any size container. Larger or smaller embodiments of the present adapter are possible for fitting any size container.

Preferably, the present adapter is a separable accessory easily positioned on and removed from standard containers, such as by snapping or screwing the opening in the mounting plate over threads. Removable embodiments of the present invention are cost effective, as the adapter is reusable after the contents of the container are depleted. In another preferred embodiment, a cap is integrally molded with the opening in the mounting plate of the adapter. The cap/adapter combination is also reusable. In other disposable embodiments of the present invention, the adapter is integrally molded with the body of the container.

The edges of the opening in the mounting plate may abut the outer surfaces of the container or the outer surfaces of the bottle cap. The bottle cap may be any cap, including a quick opening and closing flip-top or a push and pull cap. Nozzles or other extensions may be fitted to the cap and may extend through either the open top or the cutout region in the side walls of the adapter.

Usually a bottle has a radially extending shoulder at the end of the threads. The open edge of the cap is spaced from the shoulder to ensure sealing of the internal cap seal against the open end of the neck. It is in that space between the shoulder and open end of the fully secured seated cap in which the mounting plate opening of the adapter is held. It is not necessary that the mounting be sealed, but it is preferred that the adapter be snug without displacing the bottle cap, so that the cap-neck seal at the end of the bottle is maintained.

A stand adapter apparatus for holding a container in an inverted position includes a mounting plate having an upper surface and a lower surface. Side walls extend from the upper surface of the mounting plate. The side walls have lower edges which form the base. An open base end for standing is defined by the lower edges of the side walls. The mounting plate further includes an opening for receiving outer surfaces of walls of the container. Bottom walls extend from the lower surface of the mounting plate. Preferably, the mounting plate is generally circular and the bottom walls form a circular ring extending from the lower surface of the mounting plate. The bottom walls decrease in thickness as the bottom walls extend from the lower surface of the mounting plate. The side walls preferably include at least one cutout region for providing lateral access to a cavity defined by the upper surface of the mounting plate and the side walls and to facilitate pouring of the contents of the bottle.

An apparatus for carrying viscous substances includes a container having an exit port and a stand adapter positioned around the exit port for holding the container in an inverted position.

A method of positioning a bottle in an inverted position includes the step of providing an adapter having a mounting plate with an upper surface, a lower surface and an opening, side walls extending from the upper surface of the mounting plate, the side walls having first edges connected to the upper surface of the base and free edges, and a base defined by the free edges of the side walls. A bottle having a neck with an exit port and a threaded wall region adjacent the exit port is also provided. The adapter is positioned around the neck of the bottle, preferably immediately beneath the threaded wall region. The positioning step includes abutting edges of the opening in the mounting plate of the adapter to outer surfaces of the neck beneath the threaded surface. A cap is screwed on the threaded surface of the neck for closing the exit port and for trapping the adapter on the bottle.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
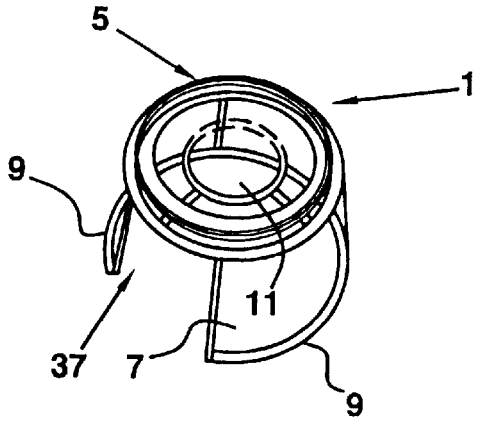
FIG. 1 is a perspective view of the present invention.

Referring to FIGS. 1–11, showing the present invention, the stand adapter is generally referred to by the numeral 1. The stand adapter holds a container 3 in an inverted position. The adapter 1 is preferably a one-piece molded structure that includes a mounting plate 5, side walls 7 and an open base 9. The mounting plate 5 includes an opening 11 having dimensions for receiving walls 13 of a bottle-type container neck. The adapter 1 is preferably removably connected to the container 3. The adapter 1 may also be constructed as part of the container 3 or the container cap 15.

Figure 8:
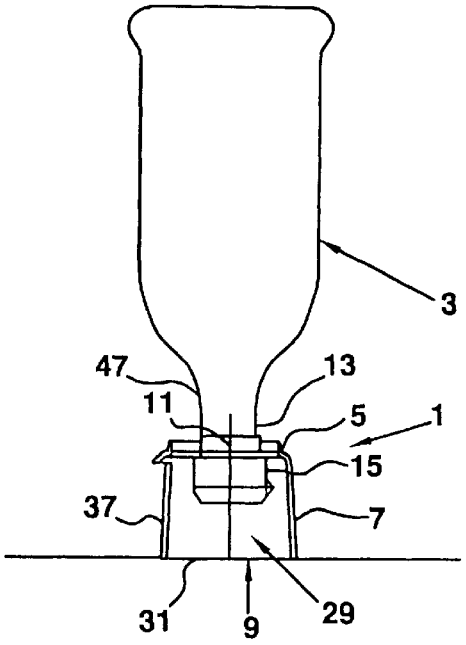
FIG. 8 shows a preferred embodiment of the present adapter connected to a neck of a bottle near the bottle cap.
Figure 9:
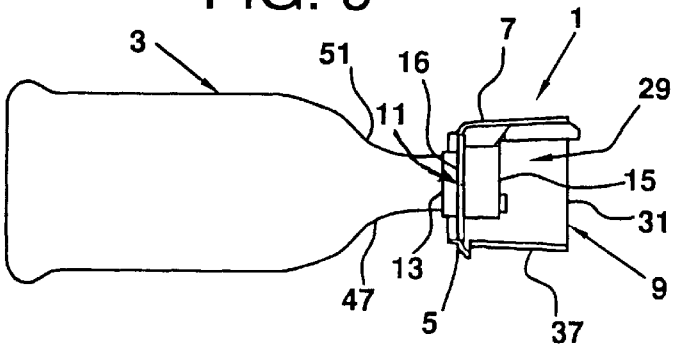
FIG. 9 shows the adapter/bottle combination of FIG. 8 having an opened flip-top bottle cap.
Figure 10:
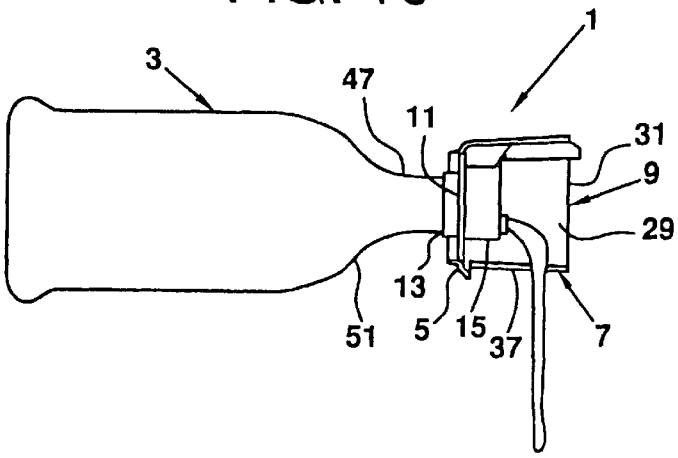
FIG. 10 shows facilitated pouring of the contents of the bottle through the cutout region in the adapter.

As shown in FIGS. 2–4 and 8–10, the mounting plate 5 of the adapter 1 includes a central opening 11. The opening 11 may have any acceptable diameter. The diameter of the opening 11 may be selectable and/or adjustable, such as by providing a non-round hole, circular perforations or radial slits, or by making the mounting plate 5 slightly stretchable . The opening 11 receives a threaded wall 13 of the neck of the container 3 around the exit port of the container 3. Edges 19 of the opening 11 abut the walls 13. In preferred embodiments of the present invention 1, the edges 19 of the opening 11 frictionally engage the walls 13 of the neck of the container 3 for securely mounting the adapter 1 on the container 3. As shown in FIGS. 8–10, the stand adapter 1 is preferably connected to the container 3 inward of the cap 15 for capturing the adapter 1 between the cap 15 and the shelf 16 on the container 3. Alternatively, the stand adapter 1 may be fixed by bonding, welding or molding the adapter 1 on the cap 15, so that the cap 15 and stand adapter 1 may be mounted and removed as a unit. Attachment means may also be included to hold the adapter 1 in place, such as adhesive.

The opening 11 in the mounting plate 5 may have any shape. Preferably, the opening 11 is generally circular, as the necks of many existing condiment bottles have generally circular cross-sections. The mounting plate 5 is preferably planar, curved or semispheroidal.

Figure 2:
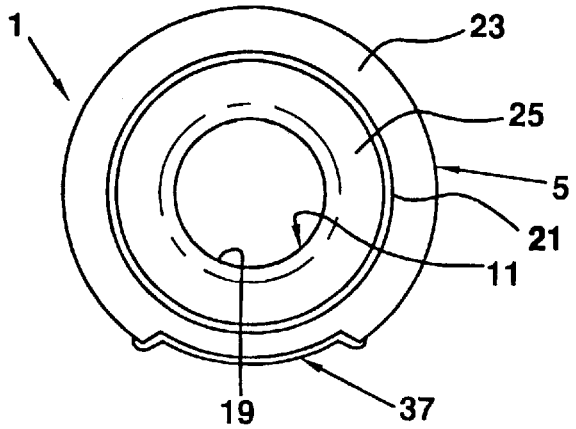
FIG. 2 is a plan view of a preferred embodiment of the present invention.
Figure 4:
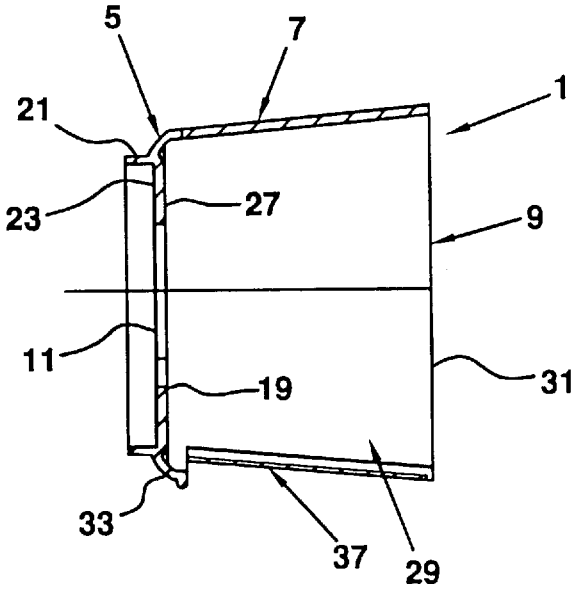
FIG. 4 is a cross-sectional view of the adapter of FIG. 3 along A—A.

As shown in FIGS. 2 and 4, bottom rims 21 extend from the outer surface 23 of the mounting plate 5. The bottom rims 21 are short, preferably much shorter than the side walls 7. As shown in FIG. 2, the bottom rims 21 preferably form a ring around the opening 11.

Figure 3:
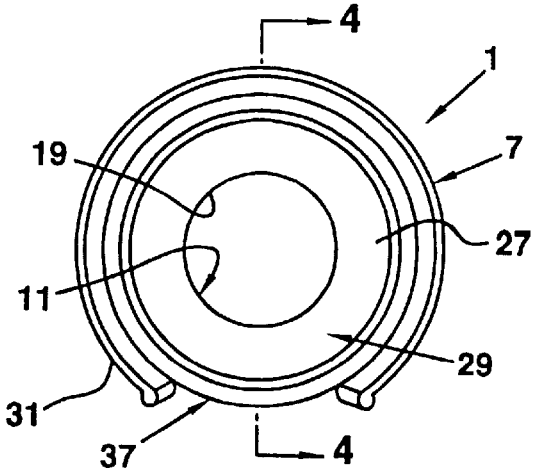
FIG. 3 is a bottom view of the adapter of FIG. 2.

FIGS. 2–4 show a preferred embodiment of the present adapter 1 having a generally planar, circular mounting plate 5, a generally circular opening 11 in the mounting plate 5 and bottom rims 21 extending from the outer surface 23 of the mounting plate 5 and forming a circular ring around the opening 11. The mounting plate 5, the opening 11 in the mounting plate 5 and the bottom rims 21 may take any acceptable shape.

Figure 5:
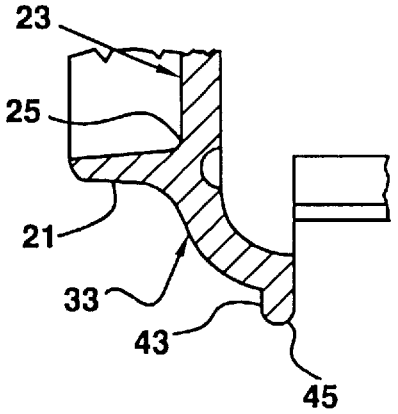
FIG. 5 is a detail of the mounting plate/side wall connection of the adapter of FIG. 4.
Figure 6:
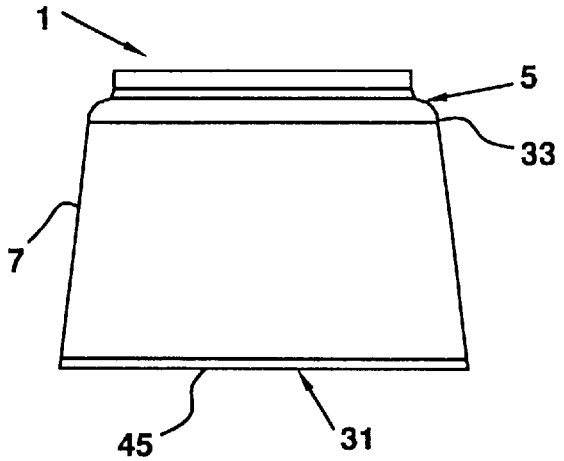
FIG. 6 is a side view of the adapter of FIG. 2.

As shown in FIG. 4, the bottom rims 21 preferably extend from inner regions 25 of the outer surface 23 of the mounting plate 5. As shown in FIG. 5, the bottom rims 21 preferably decrease in thickness as they extend from the base 5.

As shown in FIGS. 2–7, side walls 7 extend from edges of the inner surface 27 of the mounting plate 5. Preferably, the side walls 7 slope slightly outward from the mounting plate 5. The side walls 7 and the inner surface 27 of the mounting plate 5 form a cavity 29 for receiving a cap of a container. Free edges 31 of the side walls 7 define an open base 9. Preferably, the side walls 7 are spaced such that a person's fingers easily extend into the cavity 29 through the open base 9 for removing or opening the container cap.

Figure 11A:
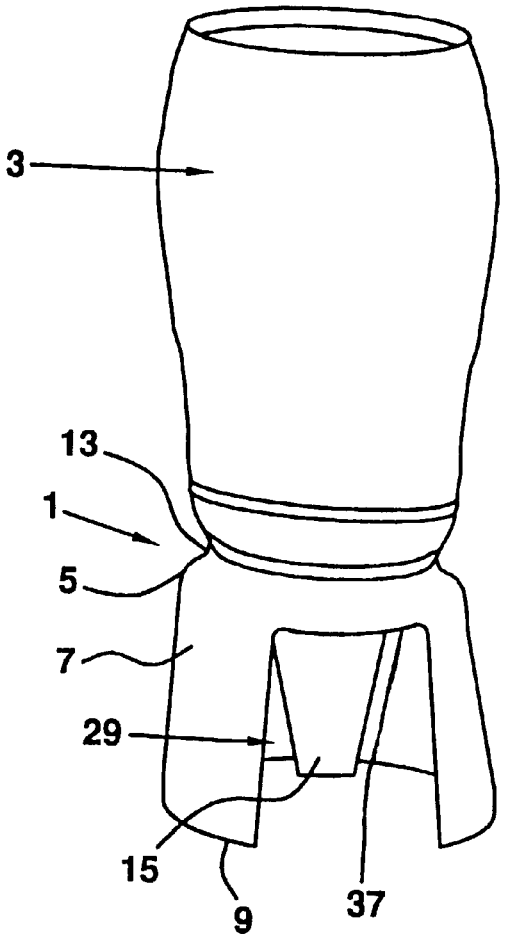
FIGS. 11A and 11B show bottle/adapter combinations in an inverted position resting on the stand adapter and an upright orientation, respectively.

As shown in FIGS. 2–7, the side walls 7 preferably extend upward from outer edges 33 of the inner surface 27 of the mounting plate 5. When the mounting plate 5 is generally circular, as shown in FIGS. 2–7, the side walls 7 preferably form a cylindrical cavity 29. The outer edges 33 are preferably rounded, as shown in FIG. 5. Free edges 31 of the side walls 7 generally extend beyond the exit end of the container 3, including the cap 15. The side walls 7 function as a stand for holding the container 3 in an inverted position, as shown in FIGS. 8 and 11A.

Figure 7:
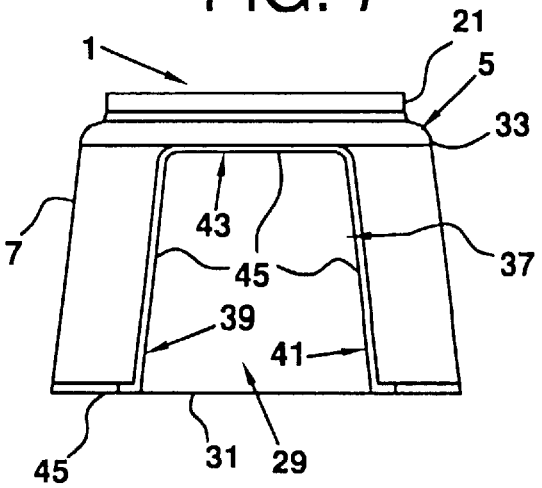
FIG. 7 is a side view of the adapter of FIG. 2 showing the cutout region in the side walls.

Cutout regions 37 are positioned in the side walls 7 of the stand adapter 1 to provide lateral access to the cap-receiving cavity 29 and to facilitate pouring of the contents from the container 3. In one preferred embodiment, as shown in FIGS. 2–7, the side walls 7 form a partially continuous ring having a cutout region 37 defined by opposing side edges 39, 41 of the ring and an outer edge 43 of the mounting plate 5. The opposing side edges 39, 41 of side walls 7 and the outer edge 43 of the mounting plate 5 defining the cutout region 37 preferably include rounded lips 45, as shown in FIGS. 3, 5 and 7. More than one cutout region 37 may be provided in the side walls 7. The cutout region 37 may have any acceptable dimension. In preferred embodiments, the dimensions of the cutout region 37 allow for lateral entry and exit of one or more fingers and a thumb into and out of the cap-receiving cavity 29.

FIGS. 8–10 show a method of using a preferred bottle/stand adapter 1 combination of the present invention. A stand adapter 1, which includes a mounting plate 5 having a central opening 11, side walls 7 and an open base 9, is positioned around the neck 47 of a bottle 3. In preferred reusable embodiments of the adapter 1, the opening 11 in the mounting plate 5 of the adapter 1 removably receives the threaded portion of the neck 47 of the bottle 3. In other preferred reusable embodiments, the opening 11 in the mounting plate 5 has dimensions for receiving and frictionally engaging side walls of a cap 15. In yet other preferred reusable embodiments, the outer side surfaces of the cap 15 are integrally molded with edges 19 of the opening 11 in the mounting plate 5. Disposable embodiments of the adapter 1 are integrally molded with the bottle 3.

As shown in FIGS. 8–10, the stand adapter 1 is positioned around the end of the container 3 defining the exit port. The exit end of the container 3 is positioned in the cavity 29 created by the side walls 7 of the stand adapter 1. The side walls 7 extend beyond the exit port of the container 3 and the cap 15 covering the exit port, as shown in FIGS. 8–10. That allows the side walls 7 of the stand adapter 1 to stably hold the container 3 in an inverted position while elevating the cap above a shelf or table.

Preferably, the container 3 is a bottle having a radially extending shoulder 51 at the end of the threaded portion of the neck 47. An open end 16 of the cap 15 is spaced from the shoulder 51 to ensure seating of the internal cap seal against the open end of the neck 47. The edges 19 of the opening 11 in the mounting plate 5 abut the neck 47 in the space between the shoulder 51 and the open edge of the fully secured and seated cap 15. Preferably the open end 16 of the cap 15 squeezes the mounting plate 5 against the shoulder 51, with a pressure that allows the mounting plate 5 to turn, but not easily, so that the mounting plate 5 holds its directional position.

Figure 11B:
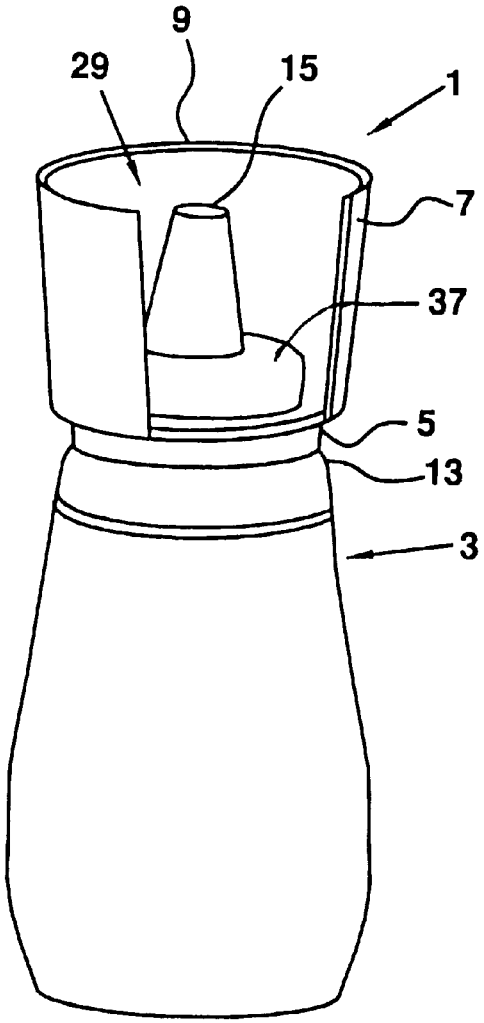

The container 3 is stored in an inverted position, as shown in FIGS. 8 and 11A. The side walls 7 of the adapter 1 stably support the weight of the container 3. For retail, the container is positioned upright, as shown in FIG. 11B. The stand adapter 1 may be positioned around the neck 47 of the container 3 ready for use, as shown in FIG. 11B. Alternatively, the stand adapter 1 is inverted, with the side walls 7 of the stand adapter 1 extending along the walls of the container 3. The bottle 3 may be used with the stand adapter 1 in the stored position until the contents diminish. Thereupon, the stand adapter 1 can be removed, inverted and reattached in its functional position.

FIGS. 8–10 detail the facilitated removal of viscous contents from containers 3 equipped with the present stand adapter 1. Initially, the container 3 is stored in an inverted position, as shown in FIG. 8, with the free edges 31 of side walls 7 resting securely on a flat surface. For dispensing contents from the container, a person lifts the container 3 and opens the cap 15 by inserting finger tips and a thumb through the cutout region 37 or the open base 9 and into the cavity 29 and unscrewing the cap 15 from the exit port of the container 3 or twisting or flipping the cap 15 to an open position. When the cap 15 includes a nozzle or flip-top or push-pull nozzle, as shown in FIGS. 8–10, the person inserts fingers or a thumb in the cavity 29 via the open base 9 or the cutout region 37 of the side walls 7 and opens the cap 15. As shown in FIG. 10, the container is held horizontal at an angle, or vertical, if preferred, and the contents are dispensed without turning the container 3 upright. The cutout region 37 in the side walls 7 permits pouring of the contents through the cutout region 37 while the container 3 is tipped. Without the cutout region 37, the container 3 would have to be held vertically or the poured fluid would contact the side walls 7 of the stand adapter 1.

Preferably, the stand adapter 1 rotates into a fixed position around the neck 47 of the container 3 for properly aligning the cutout region 37 with the cap 15 during use.

While the invention has been described with reference to specific embodiments, modifications and variations of the invention may be constructed without departing from the scope of the invention, which is defined in the following claims.

We claim:

1. An adapter apparatus for holding a container in an inverted position comprising a mounting plate having an inner surface and an outer surface, side walls extending from the inner surface of the mounting plate, the side walls having proximal edges connected to the mounting plate and having free distal edges, an open base on the distal edges of the side walls, and an opening in the mounting plate for engaging outer surfaces of walls of the container, wherein the side walls further comprise at least one cutout region extending from the distal edges to the proximal edges for providing lateral access to a cavity defined by the inner surface of the mounting plate and the side walls and for facilitating pouring of contents of the container.

2. The apparatus of claim 1, further comprising a rim extending from the outer surface of the mounting plate.

3. The apparatus of claim 2, wherein the mounting plate is generally circular and wherein the rim forms a circular ring extending from the outer surface of the mounting plate.

4. The apparatus of claim 2, wherein the rim decreases in thickness as the rim extends from the outer surface of the mounting plate.

5. The apparatus of claim 1, wherein the opening has a first diameter, and wherein edges of the opening abut the outer surfaces of the walls of the container.

6. The apparatus of claim 5, wherein the container is a bottle having a neck with a second diameter, wherein the first diameter is slightly larger than the second diameter, and wherein the edges of the opening engage surface features on the outer surface of the wall of the neck.

7. The apparatus of claim 5, wherein the first diameter is adjustable.

8. The apparatus of claim 1, wherein the side walls extend from outer edges of the inner surface of the mounting plate.

9. The apparatus of claim 8, wherein the outer edges of the inner surface are rounded.

10. The apparatus of claim 8, wherein the side walls extend outward from the outer edges of the inner surface of the mounting plate.

11. The apparatus of claim 8, wherein the mounting plate is generally circular and wherein the mounting plate and the side walls extending from the inner surface of the mounting form a generally tubular cap-receiving cavity.

12. The apparatus of claim 1, wherein the mounting plate has a shape selected from the group consisting of generally planar, curved and semispheroidal, and wherein the side walls form a partially-continuous ring.

13. The apparatus of claim 12, wherein the cutout region is defined by opposing side edges of the partially continuous ring and a top outer edge of the inner surface of the mounting plate.

14. The apparatus of claim 13, wherein the opposing side edges and the top outer edge further comprise rounded lips.

15. An adapter apparatus for holding a container in an inverted position comprising a mounting plate for attaching to a container, a side wall extending from the mounting plate, the side wall having proximal edges connected to the mounting plate and having distal edges, a base on the distal edges of the side wall, an opening in the mounting plate for engaging the container, and a cutout region in the side wall for accessing the container and pouring contents of the container out through the cutout region, wherein the cutout region extends from the distal edges of the side wall toward the proximal edges of the side wall.

16. The apparatus of claim 15, further comprising a rim extending from the mounting plate opposite the side wall.

17. The apparatus of claim 15, wherein the mounting plate is generally circular and wherein the side wall forms a partially cylindrical wall extending from the mounting plate.

18. The apparatus of claim 15, wherein the opening has a first diameter, and wherein edges of the opening abut outer surfaces of the container.

19. The apparatus of claim 18, wherein the container is a bottle having a neck with a second diameter, wherein the first diameter is slightly larger than the second diameter, and wherein the edges of the opening engage surface features on the neck.

20. The apparatus of claim 15, wherein the side wall extends from outer edges of the mounting plate.

21. The apparatus of claim 20, wherein the outer edges are rounded.

22. The apparatus of claim 20, wherein the side wall extends axially and radially outward from the mounting plate.

23. The apparatus of claim 20, wherein the mounting plate is generally circular and wherein the mounting plate and the side wall extending from the mounting plate form a generally tubular cap-receiving cavity.

24. The apparatus of claim 15, wherein the mounting plate has a shape selected from the group consisting of generally planar, curved and semispheroidal, and wherein the side wall forms a partially-continuous ring.

25. An adapter apparatus for holding a container in an inverted position comprising a mounting plate for attaching to a container, a side wall extending from the mounting plate, the side wall having proximal edges connected to the mounting plate and having distal edges, a base on the distal edges of the side wall, an opening in the mounting plate for engaging the container, and a cutout region in the side wall for accessing the container and pouring contents of the container out through the cutout region, wherein the side wall decreases in thickness as the side wall extends from the mounting plate.

26. An adapter apparatus for holding a container in an inverted position comprising a mounting plate for attaching to a container, a side wall extending from the mounting plate, the side wall having proximal edges connected to the mounting plate and having distal edges, a base on the distal edges of the side wall, an opening in the mounting plate for engaging the container, and a cutout region in the side wall for accessing the container and pouring contents of the container out through the cutout region, wherein the opening has a first diameter, and wherein edges of the opening abut outer surfaces of the container, wherein the first diameter is adjustable.

27. An adapter apparatus for holding a container in an inverted position comprising a mounting plate for attaching to a container, a side wall extending from the mounting plate, the side wall having proximal edges connected to the mounting plate and having distal edges, a base on the distal edges of the side wall, an opening in the mounting plate for engaging the container, and a cutout region in the side wall for accessing the container and pouring contents of the container out through the cutout region, wherein the mounting plate has a share selected from the group consisting of generally planar, curved and semispheroidal, and wherein the side wall forms a partially-continuous ring, wherein the cutout region is defined by opposing side edges of the partially-continuous ring and a top outer edge of an inner surface of the mounting plate.

28. The apparatus of claim 27, wherein the opposing side edges and the top outer edge further comprise rounded lips.

* * * * *